United States Patent [19]

Steinke

[11] Patent Number: 4,624,176

[45] Date of Patent: Nov. 25, 1986

[54] AIR VENT WITH FLOATING CLOSURE

[76] Inventor: Wayne Steinke, Hope, N. Dak. 58046

[21] Appl. No.: 720,683

[22] Filed: Apr. 8, 1985

[51] Int. Cl.[4] ..... F23J 13/00

[52] U.S. Cl. ..... 98/119; 137/533.11

[58] Field of Search ..... 98/79, 85, 116, 119, 98/122; 137/533.11; 34/235; 248/65

[56] References Cited

U.S. PATENT DOCUMENTS

| | | | |
|---|---|---|---|
| 611,040 | 9/1898 | Mather | 137/533.11 X |
| 1,369,566 | 2/1921 | Smidley | 98/119 |
| 1,579,543 | 4/1926 | King | 137/533.11 X |
| 2,730,943 | 1/1956 | Klein | 98/119 |
| 3,124,053 | 3/1964 | Zahn et al. | 98/119 X |
| 3,466,819 | 9/1969 | Giger | 52/1 |
| 3,502,047 | 3/1970 | Crosbie | 114/212 |
| 3,541,945 | 11/1970 | Wexler | 98/119 |
| 3,813,896 | 6/1974 | Lebahn | 62/409 |
| 3,921,663 | 11/1975 | Beranek et al. | 137/533.11 |
| 4,338,731 | 7/1982 | Shames et al. | 34/82 |

FOREIGN PATENT DOCUMENTS

| | | | |
|---|---|---|---|
| 168979 | 9/1951 | Austria | 98/79 |

*Primary Examiner*—Harold Joyce

*Attorney, Agent, or Firm*—Kinney & Lange

[57] ABSTRACT

An air vent for a dryer or the like in which the air vent is located outside of the building and has a light weight valve member which rests upon the end of a pipe leading to the blower outlet. Normally this light weight closure is effective to close off the end of the pipe and prevent the entrance of cold air into the pipe. When the blower is turned on, the light weight valve member floats upwardly and permits air to pass out through various openings. The vent includes a housing which encloses the light weight valve member and the upper portion of the pipe against which the valve member seats. The valve member may be of spherical form. The housing has a cover which may be either spaced from the housing to permit air to pass out between the cover and the housing, or fitted tightly to the top of the housing so that all of the air leaving the blower has to pass downwardly between the pipe and the housing.

7 Claims, 4 Drawing Figures

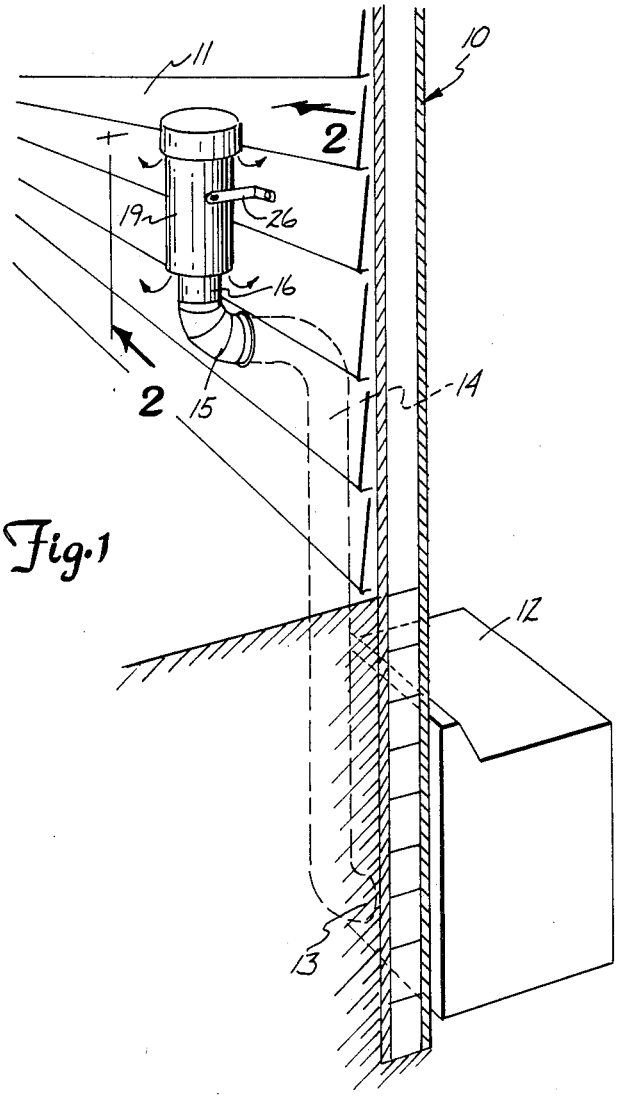
Fig. 1
Fig. 2
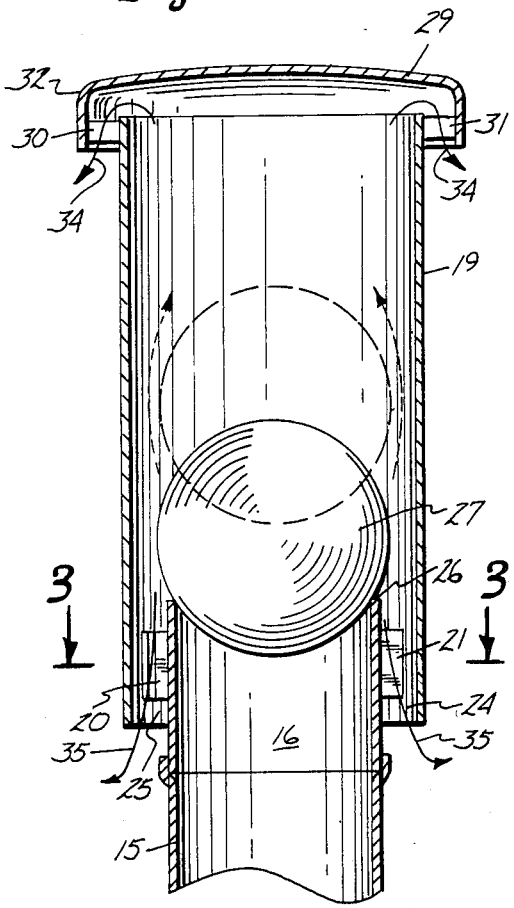
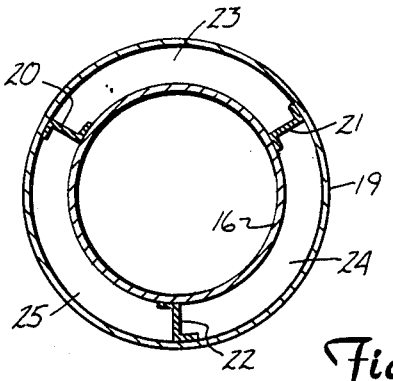
Fig. 3
Fig. 4
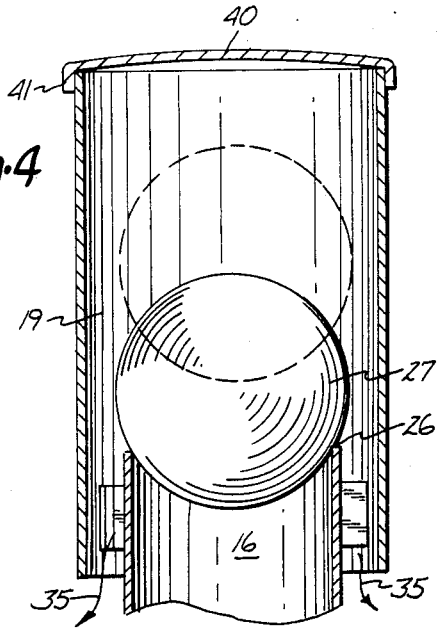

AIR VENT WITH FLOATING CLOSURE

BACKGROUND OF THE INVENTION

1. Field of the Invention

A closure for an externally located air vent, such as is used with clothes dryers.

2. Description of the Prior Art

Where it is necessary to vent to the outside the output of an air blower located inside of a building, a problem arises in securing adequate closure of the vent when the blower is not operating. The customary way of doing this is to provide a pivoted vane which drops by gravity to a closed position as soon as the operation of the blower is stopped. The difficulty with such an arrangement is that various foreign matter tends to accumulate on the outlet of the vent so as to prevent complete closure of the vent. This is particularly true in the case of a clothes dryer where, despite lint guards, an appreciable amount of lint is driven out through the air vent and tends to accumulate on the outlet of the vent. Such lint also enters the pivotal support of the vane to hinder its closing. This is very serious in connection with cold climates, since it permits cold air to pass from the outside into the apparatus with the blower and hence out to the room.

The Wexler U.S. Pat. No. 3,541,945 shows an air vent of the type in which there is a pivoted vane. In this case, a magnet is provided to prevent the valve from moving to an open position when the wind is blowing. While the arrangement of the Wexler patent undoubtedly takes care of a situation in which there is a slight differential pressure due to the wind blowing, it does not insure the closing of the vent valve. In other words, if the pivot pins become clogged with lint or if the end of the pipe against which the vane seats become clogged with lint, the vane will never seat in the first place, regardless of the magnet.

In a somewhat related field, the Lebahn U.S. Pat. No. 3,813,896 shows a vent arrangement for a freezer cabinet in which provision is made for guarding against pressure building up in the cabinet or a vacuum being formed. Where pressure builds up, there is a light weight ball which rests upon a valve seat and which is raised when the pressure builds up to relieve the pressure. This is not concerned, however, with the same problem as that of applicant's, in which there is an outside vent.

The Klein U.S. Pat. No. 2,730,943 shows another arrangement of a swinging vane for a clothes dryer. Here small openings are provided in the vane to permit warm air to flow out through the bleed openings to melt any ice. This is intended to take care of a situation in which the swinging vane freezes closed. This still does not, of course, take care of the situation of foreign matter accumulating on the edge of the vent or on the pivotal support of the vane.

SUMMARY OF THE INVENTION

The present invention is concerned with an arrangement in which instead of using a swinging valve in the vent, a light weight floating valve member is employed. There is an outer housing designed to be secured to the wall of a building and a cylindrical pipe designed to be connected to an air blower and extending into the housing. The floating member normally rests on the top of the pipe and prevents cold air from coming into the pipe and hence down into the equipment in the house with the blower. Whenever the blower is turned on, however, the floating member rises upwardly to permit the escape of air. To further prevent cold air from entering, the housing is provided with a suitable covering which may be spaced from the upper end of the housing or may be closed. The means for supporting the pipe within the housing has openings therethrough to allow air to pass downwardly through the openings.

When the light weight floating valve member is away from the end of the pipe due to the blower being in operation, at least some of the air passes downwardly through the openings of this supporting means. Where the cover engages the top of the housing, all of the air passes down through these openings.

The floating valve member may be in the form of a spherical ball formed of some light weight plastic. In such a case, the ball member has a diameter greater than that of the pipe but less than that of the housing. In a typical case, the pipe has a diameter of four inches, and the housing has a diameter of approximately six inches.

Means are provided in connection with my device for mounting the housing on the exterior wall of a building.

The means for securing the pipe within the housing can take the form of a plurality of spaced ribs, the spaces between the ribs constituting the openings through the securing means. These ribs may be radially extending ribs.

Further features of the invention will be apparent from a consideration of the accompanying specification, claims and drawing.

BRIEF DESCRIPTION OF THE DRAWINGS

FIG. 1 is a perspective view showing the improved vent and a dryer, the blower outlet of which is connected to the improved vent. In the drawing, a portion of the wall and the adjacent ground is cut away to show the path of the vent pipe;

FIG. 2 is a vertical sectional view taken along the line 2—2 of FIG. 1;

FIG. 3 is a transverse sectional view taken along the line 3—3 of FIG. 2; and FIG. 4 is a view similar to FIG. 2 but showing a modified form in which a cover is tightly secured to the top of the housing and completely closes the same.

DETAILED DESCRIPTION OF THE PREFERRED EMBODIMENTS

Referring to the drawings, the reference numeral 10 is used to indicate the wall of a building, the exterior of which has conventional siding 11. Located inside of the building is an appliance 12 with an air blower therein (not shown). The appliance 12 may be a conventional clothes dryer in which the warm, moist air is driven out through an outlet 13 at the rear of the dryer. A vent pipe 14 is connected in a suitable manner to the blower outlet 13 and extends upwardly and through an opening in the wall 10. An elbow 15 is secured in a conventional manner to the vent pipe. This elbow 15 is in turn connected in any suitable manner to a pipe 16 forming a part of the improved air vent of the present invention.

The pipe 16 is supported within a tubular housing 19 by a plurality of radially extending ribs 20, 21 and 22, (best shown in FIG. 3) each of which have inner and outer flanges secured to the housing 19 and the pipe 16 in any suitable manner, as by welding or by a suitable adhesive. The supporting ribs 20, 21, and 22 are spaced apart to provide openings 23, 24 and 25 between the pipe 16 and the housing 19. As will be presently explained, these provide passages for air coming from the dryer 12. The housing 19, which may be of cylindrical cross-section as shown in FIG. 3, is secured to the outer wall 11 of the building in any suitable manner, as by brackets 26, which are fastened to the housing 19 in any suitable manner, such as by a suitable adhesive. These brackets are fastened at their inner end to the wall of the building with any suitable fastening means, such as screws.

It will be noted that the upper end of pipe 16 is cut off at its upper end perpendicularly to the axis of the pipe to form a flat, circular surface 26 at the top. Resting upon this flat, circular surface is a light weight valve member 27, which is shown specifically as a spherical ball. The ball may be formed of a low density plastic. In a typical case, the ball will have a weight of between two ounces and three ounces. Normally, the ball rests upon the cylindrical surface 26 at the top of pipe 16. In this position, it effectively closes off the top of the pipe and prevents any air from entering through the vent pipe 14 into the dryer 12. When, however, the blower in the dryer is turned on, the ball 27 will float upwardly, for example, to the dotted line position shown in FIG. 2 to permit the escape of air.

Normally, the housing 19 is provided with a cover 29. In the form shown in FIG. 2, the cover has a diameter somewhat greater than that of the housing 19 and is supported from the housing by ribs 30 and 31 which provide openings therebetween through which air can flow. The cover 29 is provided with a downwardly extending flange 32.

When the blower is turned on to cause the valve member 27 to raise from its seat 26 at the upper end of pipe 16, air can pass outwardly through the pipe. In the form shown in FIG. 2, the air goes both upwardly and downwardly. The air going upwardly, as shown by dotted line arrows adjacent the dotted line position of the valve 27, passes upwardly through the openings between the ribs 30 and 31 as shown by arrows 34. Similarly, air flows downwardly through the openings 23, 24 and 25, as indicated by the arrows 35.

As soon as the dryer is stopped, the ball 27 drops by gravity onto engagement with the seat 26. With this arrangement, the accumulation of any lint has no effect upon the seating of the ball 27. In the first place, it is very difficult for lint to be retained on the edge 26 of the pipe 21. One of the ways in which the closing of the ordinary swinging valve is prevented by lint, is that the lint tends to not only get over the end of the pipe against which the vane swings, but also gets into the pivot pins thus impeding the dropping of the vane valve. With the present arrangement, there are no pivotal connections and the light weight valve 27 simply floats up when the air is turned on and drops back by gravity when the air is turned off. In this way, it is always assured that the valve will firmly seat on the upper end of the pipe 16.

The flange 32 of cover 29 guards against the entrance of rain or other foreign matter into the housing 19. The only way that rain could enter into the housing would be to have such a strong wind that it would be forced upwardly between the ribs 30 and 31. This is highly unlikely.

MODIFICATION OF FIG. 4

The modification of FIG. 4 is basically the same as that of FIG. 2 with the one exception that the cover 40 closes off the top of the housing 19. It is provided with a down-turned flange 41 which is of the same internal diameter as the external diameter of the housing 19 so that the cover fits firmly onto the housing. If desired, the cover 40 may be secured to the housing in any suitable manner, such as by a suitable adhesive.

With the arrangement of FIG. 4, all of the air travels downwardly, as shown by the arrows 35. None of it travels upwardly. The arrangement of FIG. 4 has the advantage not only of being simpler to construct, but also of securely guarding against the entrance of any foreign matter into the top of housing 19. Furthermore, as cold air tends to travel downwardly, the entrance of cold air into the housing 19 is further guarded against. Most of the air has to come in from the bottom of housing 19 and then down through pipes 15 and 16. This, of course, is largely prevented by the ball 27 seated on top of pipe 16.

CONCLUSION

It will be seen that I have provided an air vent having a closure which will always operate regardless of any accumulation of lint or other foreign matter. In fact, the construction is one which tends to avoid accumulation of any lint. The arrangement is very simple and can be readily fabricated.

While I have shown certain specific embodiments of my invention, it is to be understood that this is only for purposes of illustration and that my invention is limited solely by the scope of the appended claims.

What is claimed is:

1. An air vent designed to be located outside of a building and to be connected through a wall of the building to an air blower located within the building, said vent comprising:

a housing designed to be secured to a wall of a building in closely spaced relation thereto and with the housing disposed substantially vertically;

a cylindrical pipe designed to be connected to an air blower and extending into said housing and having a cross-sectional area less than the interior cross-sectional area of the housing, said pipe terminating at an upper open end in a flat circular surface perpendicular to the axis of the pipe;

a plurality of spaced radial ribs secured to the pipe and the lower portion of the housing for securing the pipe within the housing with the axis of the pipe generally parallel to the axis of the housing so that when the housing is mounted vertically the upper flat circular surface at the open upper end of the pipe will be disposed generally horizontally, said spaced ribs providing unobstructed passages therebetween for allowing air to pass downwardly therebetween;

a light weight member having a cross-sectional area at least as great as that of the pipe but less than the cross-sectional area of the housing so that when the housing is vertical the light weight member normally rests on the flat circular upper end of the pipe to close such upper end but is free to move upwardly due to the air pressure when the air blower is operated to allow the air to pass downwardly between the radial ribs;

a cover secured to said housing at the upper end of the housing, said cover having a downturned flange secured snugly to the housing to prevent the entry of rain or other foreign matter into the housing; and bracket means secured to the vent for securing the housing to a wall of a building in spaced relation thereto with the housing substantially vertical.

2. The air vent of claim 1 in which said housing is cylindrical and in which the pipe is secured concentrically within the housing.

3. The air vent of claim 1 in which the light weight member is a spherical ball having a diameter greater than that of the pipe.

4. The air vent of claim 1 in which the pipe has a diameter of 4 inches and the housing has an internal diameter of approximately 6 inches.

5. The air vent of claim 3 in which the distance between the upper end of the pipe and the cover is substantially greater than the diameter of the ball to allow the ball to move upwardly out of engagement with the upper end of the pipe.

6. The air vent of claim 3 in which the spherical ball has a weight of between 2 ounces and 3 ounces.

7. The air vent of claim 1 in which the light weight member is made of a low density plastic.

* * * * *